United States Patent [19]

Sorensen

[11] 4,281,704

[45] Aug. 4, 1981

[54] DOOR

[76] Inventor: Ralph T. Sorensen, 230 Cedar, Junction City, Oreg. 97448

[21] Appl. No.: 75,522

[22] Filed: Sep. 13, 1979

[51] Int. Cl.[3] ..... A47H 5/00

[52] U.S. Cl. ..... 160/340; 160/354

[58] Field of Search ..... 160/40, 239, 340, 354, 160/368 R, DIG. 8

[56] References Cited

U.S. PATENT DOCUMENTS

| | | | |
|---|---|---|---|
| 472,737 | 4/1892 | Mansfield | 160/40 |
| 1,746,143 | 2/1930 | Callahan | 160/340 |
| 2,517,514 | 8/1950 | Walsh | 160/239 |

*Primary Examiner*—Kenneth Downey

*Attorney, Agent, or Firm*—James D. Givnan, Jr.

[57] ABSTRACT

A door for an interior doorway and including a pliable panel fully occupying the doorway opening and secured to one edge thereof. A rigid, diagonal member is pivotally mounted at one end and attached to the pliable panel so as to position same to normally close the doorway. The rigid member extends upwardly and diagonally terminating at a doorway corner wherein a keeper is located. A portion of the pliable panel is normally tensioned by the inclined rigid member while a remaining panel portion is suspended from the rigid member.

4 Claims, 4 Drawing Figures

DOOR

BACKGROUND OF THE INVENTION

The present invention relates generally to doors and particularly to a door utilizing a rigid diagonal member supporting a pliable member of the door.

Dressing room "doors" are often simply of the curtain type. Such do not provide the privacy desired by reason of gaps between the curtain and the door frame to the consequent dissatisfaction of the customer. Further, such curtain type doors do not enhance the appearance of a clothing store as they are usually left partially open after exit of a customer from the dressing room. Use of conventional doors for a dressing room is both costly as well as often not feasible in view of the limited area for swinging movement of the door.

SUMMARY OF THE PRESENT INVENTION

The present invention is embodied in a door or closure having an inclined rigid member extending diagonally between opposite corners of a door frame and supporting a pliable closure member.

The door is particularly suited for use for dressing rooms as it virtually closes the entire doorway opening to provide the privacy desired. The rigid, inclined member of the door is supported at one end in a pivotal manner to permit door movement. The upper end of the rigid member is normally held in place adjacent the door frame by a keeper. The pliable closure or panel component of the door is tensioned by and partially suspended from said rigid member to fully close the doorway. Said pliable panel member is secured along one upright edge of the door frame and additionally to the rigid member so as to drape in a doorway closing manner.

Important objects of the door include the provision of a door of low cost construction yet embodying novel features rendering same highly useful as, for example, closing interior doorways such as those of dressing rooms of a clothing store; the provision of a door having an inclined rigid member pivotally mounted at one of its ends so as to swing within a single or multiple planes during use; a door which provides privacy yet folds during opening and closing so as to be usable on dressing room doorways where room space is severely restricted to preclude the use of a conventional door; a door which enhances a store's interior appearance by reason of always being closed as gravity acts on the door to automatically close same.

DETAILED DESCRIPTION OF THE PREFERRED EMBODIMENT

Figure 1:
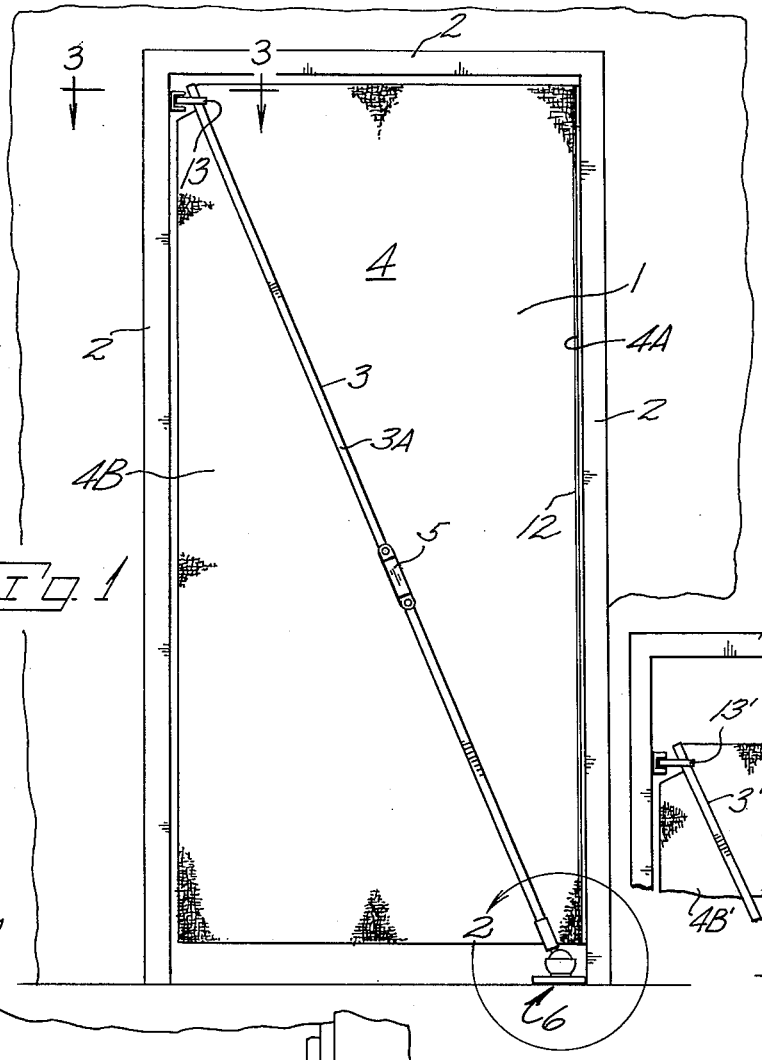
FIG. 1 is an elevational view of the present door disposed within a conventional door frame.

With continuing attention to the drawing wherein applied reference numerals indicate parts similarly identified hereafter, the reference numeral 1 indicates a doorway opening defined by a conventional door frame

2. Door frame 2 is intended to be typical of an interior door frame within a building structure, however, the present door invention is not intended to be restricted to any particular use.

Disposed in a diagonally inclined manner within the doorway is an elongate rigid member 3 having its ends disposed adjacent diagonally opposite corners of the doorway. Rigid member 3 is shown comprised of a pair of components 3A between which is secured, by suitable means, a pliable doorway closure panel 4. Affixed to each component 3A of rigid doorway member 3 is a handle at 5.

Figure 2:
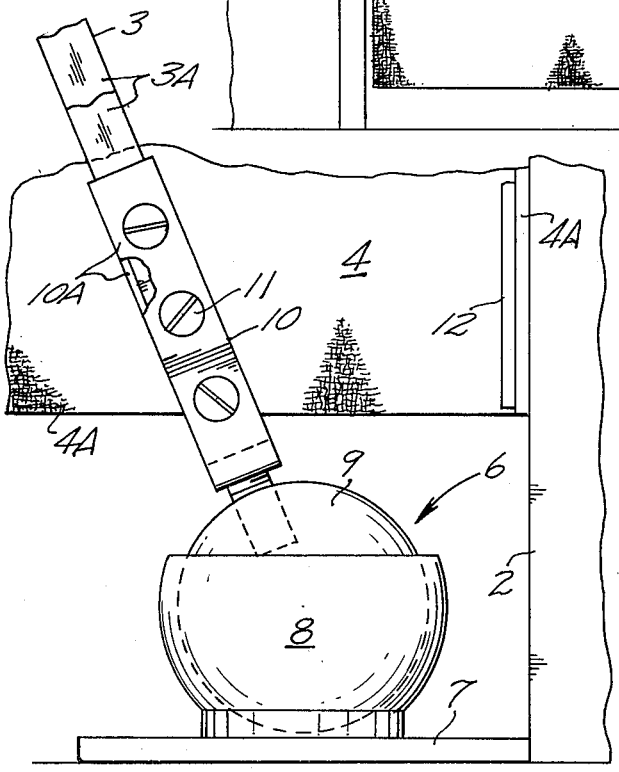
FIG. 2 is an enlarged detailed view of that portion of the door encircled at 2 in FIG. 1.
Figure 3:
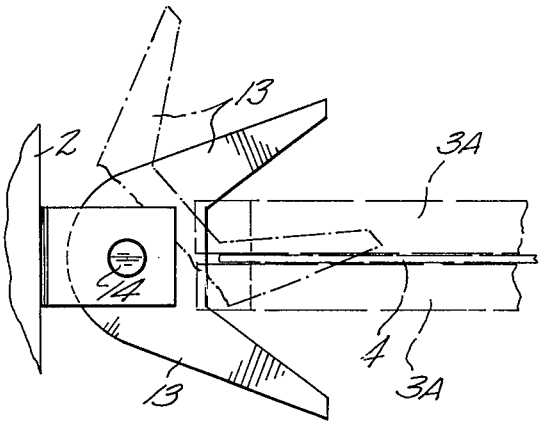
FIG. 3 is a horizontal view of a door keeper taken downwardly along 3—3 of FIG. 1.

Secured adjacent one upright or side member of the door frame are pivot means indicated generally at 6. With attention to FIG. 2, the pivot means includes a floor mounted base 7 having a socket 8. A ball 9 is pivotally retained within said socket to provide a ball-and-socket type support for the elongate, rigid member 3. Rigid member 3 is coupled to ball 9 by a U-shaped bracket 10 having a pair of arms 10A between which member 3 is secured as by fasteners 11. The particular manner of ball attachment is unimportant to the present invention as various other arrangements would be suitable.

Pliable panel member 4 normally occupies the doorway opening to fully close same. An edge 4A of the pliable panel member is secured along its length to an upright side member of the door frame such being by means of a strip 12 and fasteners (not shown). In a closed positon, pliable panel member 4 is partially tensioned by elongate rigid member 3 which automatically centers itself under the influence of gravity while a remaining portion at 4B of pliable panel member is suspended from rigid member 3.

A keeper at 13 is mounted to the remaining upright member of the door frame at a diagonally opposed corner from pivot means 6 for the purpose of receiving and retaining the unmounted end of rigid member 3. Said keeper is preferably of the rotatable type to facilitate release of rigid member 3 during door opening and, conversely, to receive and hold said member during door closing. Keeper 13 rotates about a pivot pin 14.

In use, the door handle 5 is grasped with light forward pressure applied resulting in the upper end of rigid member 3 being released from keeper 13 to swing in an inclined manner about pivot means 6. Door opening may also be accomplished by displacement of rigid member 3 toward the vertical once it has moved beyond the door frame. Door closure is substantially automatic as rigid member 3 gravitates toward a position coplanar with door frame 2. Accordingly, upon release of the door, the same will automatically close to provide a fully closed door opening of attractive appearance.

Figure 4:
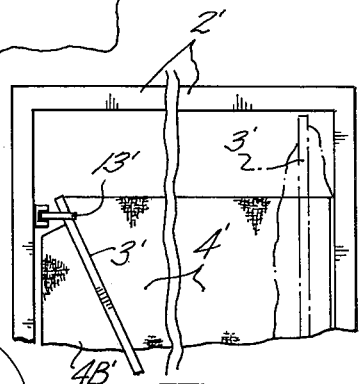
FIG. 4 is a fragmentary elevational view of a modified door.

In FIG. 4 I show a door modification with analogous parts indicated by prime reference numerals wherein an elongate rigid member at 3' is somewhat of shorter length than the first described counterpart at 3. Similarly closure panel 4' is of reduced length. Such an arrangement permits rigid member 3' to move to the open, broken line position while remaining within the confines of door frame 2'.

While I have shown but a few embodiments of the invention it will be apparent to those skilled in the art that the invention may be embodied still otherwise without departing from the spirit and scope of the invention.

Having thus described the invention, what is claimed and desired to be secured under a Letters Patent is:

1. A door for use within an interior door frame of a building structure, said door comprising, an elongate rigid member inclined so as to have its ends positionable adjacent diagonally opposite corners of a doorway, a pliable closure panel for normally occupying the door frame opening to substantially close same and affixed to said rigid member, one side of said closure panel adapted for attachment to an upright member of the door frame, a portion of said pliable closure panel is normally tensioned by said elongate rigid member with a remaining portion of said panel being suspended from said rigid member, and pivot means supporting one end of said rigid member to permit opening and closing movement thereof when said rigid member is manually displaced during door opening.

2. The door claimed in claim 1 additionally including a keeper for mounting on said door frame to receive the remaining end of said elongate rigid member when the door is closed.

3. The door claimed in claim 1 wherein said pivot means is of the type permitting movement of said upright rigid member in at least two planes.

4. The door claimed in claim 4 wherein said pivot means is of the ball-and-socket type.

* * * * *